United States Patent [19]

Beyer et al.

[11] Patent Number: 4,889,094

[45] Date of Patent: Dec. 26, 1989

[54] METHOD FOR RECOGNIZING THE POWER STROKE OF A CYLINDER OF AN INTERNAL COMBUSTION ENGINE

[75] Inventors: Hans-Ernst Beyer, Oberriexingen; Jörg Bonitz, Mühlacker; Robert Entenmann, Benningen; Siegmar Förster, Schwieberdingen; Rochus Knab, Kornwestheim; Walter Künzel, Ludwigsburg; Wolfgang Kugler, Vaihingen/Enz; Alfred Mahlberg, Freiberg; Bernhard Miller; Matthias Philipp, both of Stuttgart; Siegfried Rohde, Schwieberdingen; Stefan Unland, Ludwigsburg; Walter Viess, Schwieberdingen; Herbert Winter, Asperg; Jürgen Zimmermann, Schwieberdingen, all of Fed. Rep. of Germany

[73] Assignee: Robert Bosch GmbH, Stuttgart, Fed. Rep. of Germany

[21] Appl. No.: 138,845

[22] PCT Filed: Mar. 6, 1987

[86] PCT No.: PCT/DE87/00100

§ 371 Date: Nov. 23, 1987

§ 102(e) Date: Nov. 23, 1987

[87] PCT Pub. No.: WO87/05971

PCT Pub. Date: Oct. 8, 1987

[30] Foreign Application Priority Data

Apr. 4, 1986 [DE] Fed. Rep. of Germany ..... 3611262

[51] Int. Cl.[4] ..... F02P 5/04; F02P 1/08; F02B 5/02

[52] U.S. Cl. ..... 123/414; 123/643

[58] Field of Search ..... 123/414, 416, 643, 630; 361/236, 239; 73/116

[56] References Cited

U.S. PATENT DOCUMENTS

| | | | |
|---|---|---|---|
| 4,267,470 | 5/1981 | Kawakami et al. | 123/414 |
| 4,267,810 | 5/1981 | Wesemeyer et al. | 123/414 |
| 4,268,888 | 5/1981 | Bodig et al. | 123/414 |
| 4,335,599 | 6/1982 | Köhler | 73/116 |
| 4,429,365 | 1/1984 | Luckman et al. | 123/414 |
| 4,596,227 | 6/1986 | Hashizume | 123/643 |
| 4,656,993 | 4/1987 | Yuzawa et al. | 123/414 |

*Primary Examiner*—Raymond A. Nelli
*Attorney, Agent, or Firm*—Michael J. Striker

[57] ABSTRACT

A method for recognition of the power stroke of an internal combustion engine is proposed, in which recognition as to whether a cylinder is currently in the power stroke is possible by means of comparison of a signal that is synchronous with the crankshaft angle and a signal that is modulated by the combustion events of the engine.

9 Claims, 1 Drawing Sheet

METHOD FOR RECOGNIZING THE POWER STROKE OF A CYLINDER OF AN INTERNAL COMBUSTION ENGINE

PRIOR ART

The invention is based on a method for recognizing the power stroke of a cylinder of an internal combustion engine in particular a four-stroke piston engine having an odd number of cylinders, wherein a signal is generated which is indicative of a fixed crankshaft angle.

In certain types of control in internal combustion engines, in particular in ignition or injection control, recognition of the power stroke of a particular cylinder is necessary. Typically, a transducer is provided for this purpose, which responds to a marking provided on the cam shaft of the engine. However, since the angular accuracy of this transducer is inadequate, primarily because of the mechanical play involved, this transducer signal is linked with a signal of an rpm transducer, which responds to markings on a transducer disk that rotates with the crankshaft.

From U.S. Pat. No. 3,592,178, an electronic ignition system is known in which for regulating the ignition angle and for cylinder recognition, a transducer disk that rotates in synchronism with the rotor of the ignition distributor is used. One transducer is provided for continuous rotational angle information, and a further transducer is provided for cylinder recognition.

SUMMARY OF THE INVENTION

It is the object of the present invention to discover a method for recognizing the power stroke of a cylinder of an internal combustion engine which has the high accuracy of the angular resolution of a transducer system, and the transducer wheel of which is located directly on the crankshaft of the engine.

This object is attained by means of the method according to the invention by generating a second signal which is assigned to the basic frequency of the combustion processes in the engine, and by combining the first and second signals in logic circuits generating a recognition signal.

Advantages of the Invention

The method according to the invention has the particular advantage that it needs only a single transducer. This is advantageous in terms of cost. A further particular advantage is that the operational reliability of the system is increased, because the reduced number of system components reduces the number of possible failures.

Particularly advantageous features of the provision according to the invention are recited in the dependent claims. They are based on the use of physical variables of the engine which undergo a change due to the ongoing operational processes of the engine. The signals of transducers that may already be provided on the engine for other purposes can also be used in the method according to the invention. With the dual utilization of system components enabled thereby, a further particularly advantageous cost reduction for the overall system is possible.

DRAWING

An exemplary embodiment of the invention is shown in the drawing and described in further detail in the ensuing description. FIG. 1 is a signal diagram explaining the mode of operation; and FIG. 2 is a circuit diagram of the exemplary embodiment.

DESCRIPTION OF THE EXEMPLARY EMBODIMENT

Figure 1:
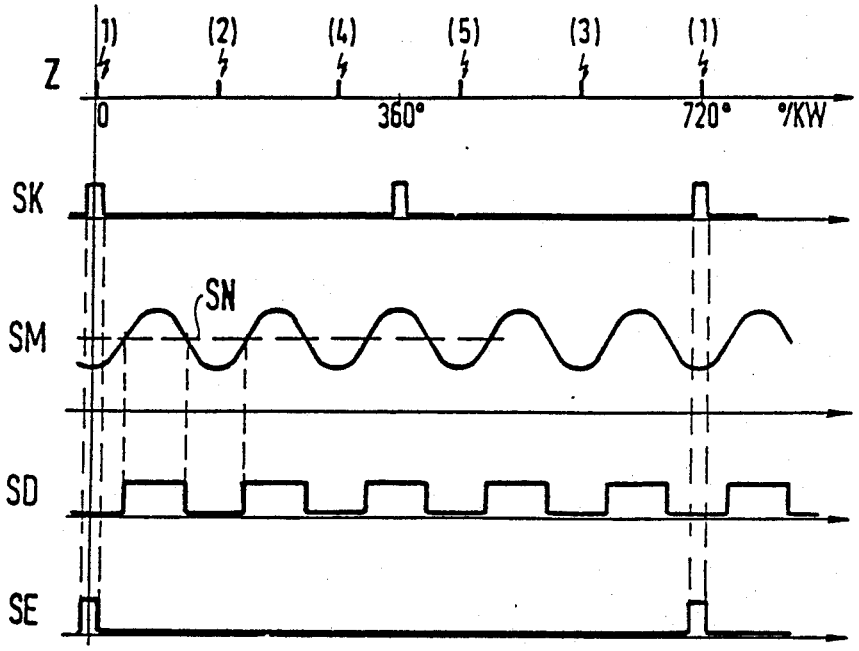

In the first line of FIG. 1, an ignition sequence Z of an operating five-cylinder internal combustion engine during two crankshaft revolutions is plotted over the crankshaft angle through which rotation has taken place. The ignition sequence of the individual cylinders, 1-2-4-5-3, is also shown. From this, it is clear that from one power stroke of one cylinder to the next, an interval of two crankshaft revolutions is necessary in each case. The illustration in FIG. 1 is fairly accurately representative of the behavior of the engine during quiet idling operation.

In the second line of FIG. 1, a signal SK is shown, which originates in a transducer that responds to a marking provided on a transducer disk that rotates synchronously with the crankshaft. The signal SK accordingly corresponds to a pulse train, which is formed by a train of individual pulses that are emitted upon each complete revolution of the transducer disk.

In the third line of FIG. 1, a signal SM is shown, which is proportional to the instantaneous rpm of the crankshaft. The signal SM is composed of a constant component SN, with a vibration component resulting from the combustion events in the engine superimposed on it. During each power stroke of a cylinder, the crankshaft of the engine is accelerated, while the other cylinders are in the compression, expulsion or aspiration stroke and therefore are consuming power. The waviness of the signal SM is due to the successive alternation of individual cylinders occurring in the ignition sequence, since the individual cylinders have a fixed phase relationship with one another via the crankshaft.

In the fourth line of FIG. 1, a signal SD is shown, which results from a digital comparison of the signal SM with its own constant portion SN. That is, the signal SD changes its state each time the modulated signal SM is greater or smaller than its own mean value SN.

As will now readily be understood, the power stroke of cylinder number 1 is recognizable in a simple manner from observing the signals SK and SD in common. By means of a simple logical combination of the signals SK and SD, a recognition signal SE is obtained, as plotted in the fifth and last line of FIG. 1. Since the individual cylinders of the engine have a fixed phase relationship with one another, the power strokes of each arbitrary cylinder can also be recognized by simple addition of the angle, although this is not shown here, for the sake of simplifying the drawing.

Figure 2:
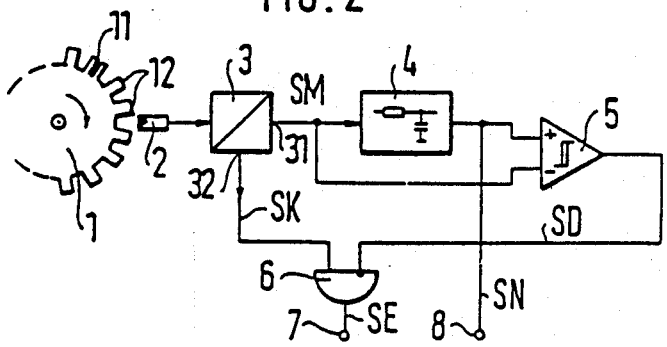

In FIG. 2, a transducer disk 1 is shown, which corresponds to a transducer disk on the engine that in actuality rotates with the crankshaft. The transducer disk 1 has a reference marking 11 and further angle markings 12. The reference marking 11 simply comprises an angle marking 12, which has been divided for the sake of reference recognition. A transducer 2 is disposed opposite the markings of the transducer disk 1, and its output signal is carried to a converter amplifier 3. The converter amplifier 3 processes the voltage signals induced in the transducer 2 into signals SM and SK, as they are represented in FIG. 1. The signal SM then appears at an output 31, and the signal SK appears at an output 32 of the converter amplifier 3. The signal SM is carried to a low-pass filter 4 and to the inverting input of a comparator 5. To lower the sensitivity to interference, the comparator 5 has a certain hysteresis, or in other words serves as a Schmitt trigger. The low-pass filter 4, at its output, forms the constant portion SN of the signal SM as illustrated in FIG. 1. The signal SK from the converter amplifier 3 and the output signal of the comparator 5, which corresponds to the signal SD of FIG. 1, are applied to a logical circuit 6, which is wired such that at its output a signal corresponding to the recognition signal SE of FIG. 1 is produced. The circuit 6 accordingly is designed as an AND gate having an inverting input for the signal SD. At two signal terminals 7, 8, the signals SE and SN, respectively, can be picked up for further processing, which is not shown in further detail for the sake of simplification.

In an entirely equivalent manner, the circuit shown in FIG. 2 can also be realized in the software of a microcomputer. This provision has advantages, not least because the output signals of the transducer 2 are already present in a form that is highly suitable for digital processing.

In the preferred exemplary embodiment, the signals of an incremental system are used for the cylinder recognition according to the invention. In other known segmental systems, other signals, which like the rotation of the crankshaft are modulated by the combustion events in the engine, are possible for the cylinder recognition according to the invention. For example, pressure signals in the intake system, in the combustion chamber or in a line carrying exhaust gas are particularly suitable; however, battery voltage, temperature and mechanical vibration of the engine are also suitable physical variables.

We claim:

1. A method for the recognition of the power stroke of a cylinder of an internal combustion engine having an odd number of cylinders, comprising the steps of forming, form a single sensor and transducer disk a first signal which depends on a predetermined crankshaft angle; forming a second signal from said same single sensor and transducer disk which corresponds to the basic frequency of the combustion events in the engine; and combining the first and second signals according to a logic function to generate a power stroke recognition signal.

2. A method as defined in claim 1 wherein said second signal is derived from the rotary speed of the crankshaft of the engine.

3. A method as defined in claim 2 wherein said second signal is derived from the rotary speed variation of the crankshaft of the engine.

4. A method as defined in claim 1 wherein said second signal is derived from the pressure variations in the air intake system of the engine.

5. A method as defined in claim 1 wherein said second signal is derived from the battery voltage variations of the engine.

6. A method as defined in claim 1 wherein said second signal is derived from the engine temperature variations.

7. A method as defined in claim 1 wherein said first and second second signals are digital signals, said first signal assuming a predetermined logical state when the work volume of the combustion chamber in a predetermined cylinder increases in size as a result of the piston motion, and said second signal assuming a predetermined logical state whenever a combustion event is taking place in any cylinder of the engine.

8. A method as defined in claim 7 wherein said second signal is inverted and combined with said first signal according to the logical and function.

9. A method as defined in claim 1 wherein said basic frequency of the combustion events is determined by the ratio of the number of cylinders of the engine to two cycles of the crankshaft.

* * * * *